US008374534B2

(12) United States Patent
Konishi et al.

(10) Patent No.: US 8,374,534 B2
(45) Date of Patent: Feb. 12, 2013

(54) HEATING DEVICE AND IMAGE FORMING APPARATUS

(75) Inventors: Masataka Konishi, Ebina (JP); Haruhiko Nishida, Ebina (JP); Toshinori Sasaki, Ebina (JP)

(73) Assignee: Fuji Xerox., Ltd., Tokyo (JP)

( * ) Notice: Subject to any disclaimer, the term of this patent is extended or adjusted under 35 U.S.C. 154(b) by 185 days.

(21) Appl. No.: 12/854,591

(22) Filed: Aug. 11, 2010

(65) Prior Publication Data

US 2011/0142505 A1 Jun. 16, 2011

(30) Foreign Application Priority Data

Dec. 10, 2009 (JP) ..... 2009-280473

(51) Int. Cl.
*G03G 15/20* (2006.01)

(52) U.S. Cl. ..... 399/323; 399/329

(58) Field of Classification Search ..... 399/323, 399/322, 329, 122, 398, 399; 271/900
See application file for complete search history.

(56) References Cited

U.S. PATENT DOCUMENTS

| | | | | |
|---|---|---|---|---|
| 2005/0008408 | A1* | 1/2005 | Inomata | 399/323 |
| 2005/0008409 | A1* | 1/2005 | Kurisu | 399/323 |
| 2005/0013638 | A1* | 1/2005 | Fukuda et al. | 399/323 |
| 2009/0226200 | A1* | 9/2009 | Ando | 399/122 X |
| 2010/0178085 | A1* | 7/2010 | Keenan et al. | 399/323 |
| 2011/0135351 | A1* | 6/2011 | Kurita et al. | 399/323 |

FOREIGN PATENT DOCUMENTS

JP A-2003-005566 1/2003

* cited by examiner

*Primary Examiner* — Sophia S Chen
(74) *Attorney, Agent, or Firm* — Oliff & Berridge, PLC

(57) ABSTRACT

A heating device includes: a heating member that heats a recording medium; a pressure member that forms a heating pressure portion between the pressure member and the heating member by coming into pressure contact with the heating member, the heating pressure portion passing through the recording medium; a tensioning member that is placed to face the pressure member with the heating member interposed therebetween, and that provides a tension to the heating member; and a guide member that guides the recording medium having passed through the heating pressure portion, and that is movable between a first secure position and a second secure position.

19 Claims, 4 Drawing Sheets

HEATING DEVICE AND IMAGE FORMING APPARATUS

CROSS REFERENCE TO RELATED APPLICATIONS

This application is based on and claims priority under 35 USC §119 from Japanese Patent Application No. 2009-280473 filed Dec. 10, 2009.

BACKGROUND

1. Technical Field

The present invention relates to a heating device and an image forming apparatus.

2. Related Art

There has been known, as a fixing device used for an image forming apparatus such as a copying machine and a printer, a device including a heating member configured with a belt member (a fixing belt) that is provided with a tension by plural rolls.

SUMMARY

According to an aspect of the present invention, there is provided a heating device including: a heating member that heats a recording medium; a pressure member that forms a heating pressure portion between the pressure member and the heating member by coming into pressure contact with an outer circumferential surface of the heating member, the heating pressure portion passing through the recording medium; a tensioning member that is placed to face the pressure member with the heating member interposed therebetween, and that provides a tension to the heating member; and a guide member that guides the recording medium having passed through the heating pressure portion, and that is movable between a first secure position and a second secure position.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the attached drawings.

<Description of Image Forming Apparatus>

Figure 1:
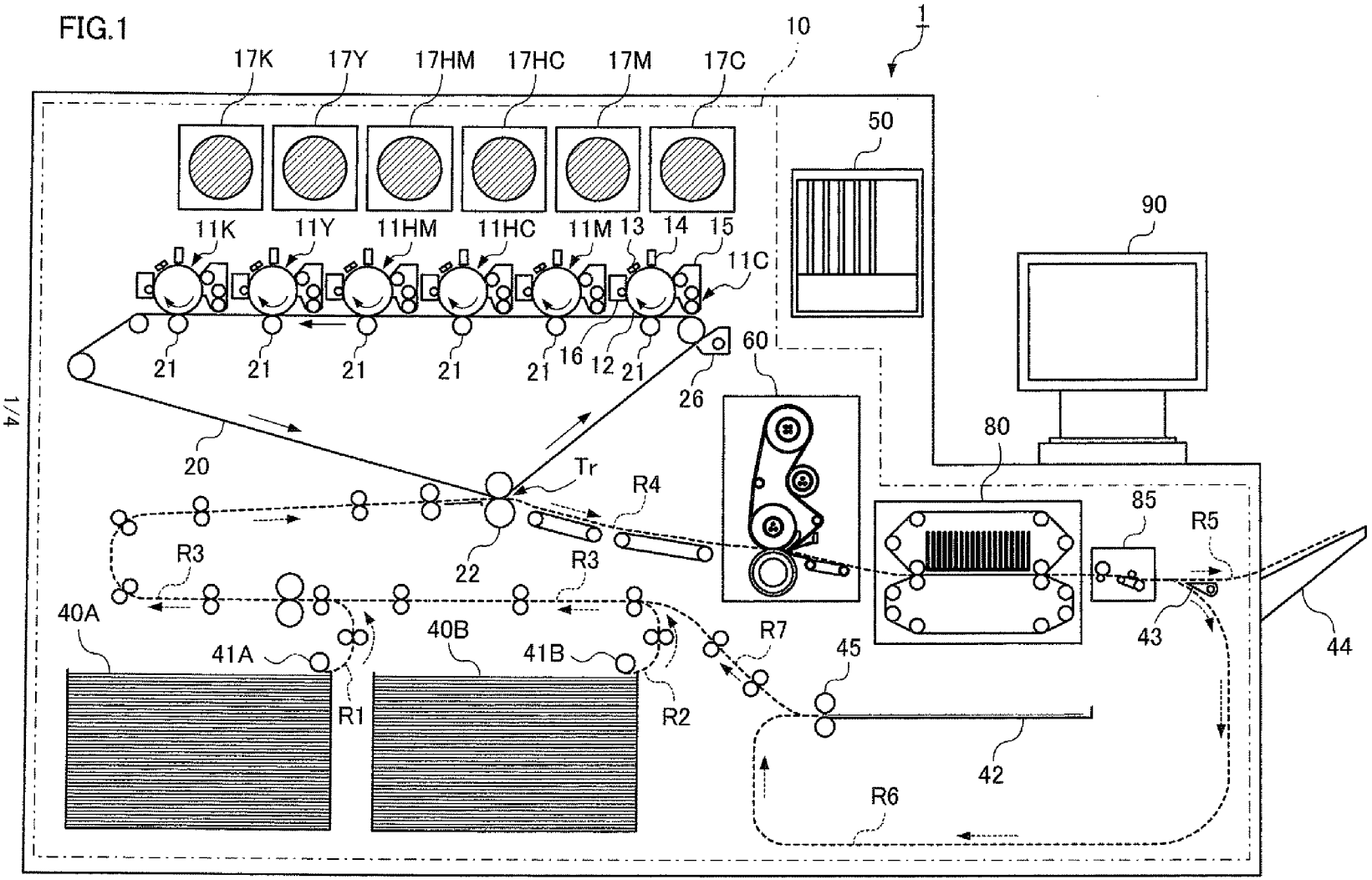
FIG. 1 illustrates a configuration example of an image forming apparatus employing a fixing unit according to an exemplary embodiment.

FIG. 1 illustrates a configuration example of an image forming apparatus 1 employing a fixing unit (heating device, heating unit) 60 according to the exemplary embodiment. The image forming apparatus 1 shown in FIG. 1 is a so-called "tandem-type" color printer, and includes: an image forming portion 10 that forms an image based on image data; a main controller 50 that performs overall control of operations of the image forming apparatus 1, communication with, for example, a personal computer (PC) or the like, image processing for image data, and the like; and a user interface (UI) portion 90 that receives an operation input from a user and displays various kinds of information to the user.

<Description of Image Forming Portion>

The image forming portion 10 is a functional portion for forming an image using for example, an electrophotographic system, and includes six image forming units 11C, 11M, 11HC, 11HM, 11Y, 11K (hereinafter, referred to as "image forming units 11") arranged in parallel, provided as an example of an image forming unit. As functional members, each image forming unit 11 includes, for example, a photoconductive drum 12, a charging device 13, an exposure device 14, a developing device 15, and a cleaner 16. On the photoconductive drum 12, an electrostatic latent image is formed, and then a toner image of a certain color is formed. The charging device 13 charges the surface of the photoconductive drum 12 at a predetermined potential. Based on image data, the exposure device 14 exposes the photoconductive drum 12 charged by the charging device 13. The developing device 15 develops the electrostatic latent image formed on the photoconductive drum 12 by toner of the certain color. The cleaner 16 cleans the surface of the photoconductive drum 12 after transfer.

The developing device 15 of each image forming unit 11 is connected, through a toner supply path (not shown), to a corresponding one of toner containers 17C, 17M, 17HC, 17HM, 17Y, 17K (hereinafter, referred to as "toner containers 17") storing toner of respective colors. The toner containers 17 replenish the developing devices 15 with toner of respective colors using replenishment screws (not shown) provided in the toner supply paths.

The image forming units 11 have almost the same configuration except for the color of toner contained in the developing devices 15. The image forming units 11 form toner images of cyan (C), magenta (M), highly saturated cyan (HC), highly saturated magenta (HM), yellow (Y), and black (K), respectively. Here, HC is cyan having a cyan hue and having a brighter color tone and a higher saturation than C. HM is magenta having a magenta hue and having a brighter color tone and a higher saturation than M.

In addition, the image forming portion 10 includes: an intermediate transfer belt 20 on which the toner images of the respective colors formed on the photoconductive drums 12 of the image forming units 11 are transferred; and primary transfer rolls 21 that transfer the toner images of the respective colors formed on the photoconductive drums 12 of the image forming units 11 onto the intermediate transfer belt 20 (primary transfer). The image forming portion 10 further includes: secondary transfer roll 22 that collectively transfers the toner images of the respective colors that have been transferred onto the intermediate transfer belt 20 in an superimposed manner onto a sheet being a recording medium (secondary transfer); and the fixing unit 60, as an example of a heating device, that fixes the toner images of the respective colors after the secondary transfer onto the sheet.

In addition, the image forming portion 10 includes: a cooling unit 80 that cools the toner images of the respective colors fixed onto the sheet by the fixing unit 60 so that toner images of the respective colors are more securely fixed onto the sheet; and a curl correction unit 85 that removes a curl in the sheet.

Note that in the image forming apparatus 1 of the exemplary embodiment, a transfer unit is formed of the intermediate transfer belt 20, the primary transfer rolls 21, and the secondary transfer roll 22. Further, an area where the secondary transfer roll 22 is placed and where the toner images of the respective colors on the intermediate transfer belt 20 are transferred onto the sheet through the secondary transfer is hereinafter referred to as "secondary transfer area Tr."

<Description of Sheet Transport System>

As a sheet transport system, the image forming portion 10 includes: multiple (two in the exemplary embodiment) sheet containers 40A and 4013 that hold sheets; pick-up rolls 41A and 4113 that pick up a sheet held in the sheet containers 40A and 40B, respectively, and transport the sheet; a first transport path R1 for transporting the sheet from the sheet container 40A; and a second transport path R2 for transporting the sheet from the sheet container 4013. The image forming portion 10 further includes a third transport path R3 for transporting the sheet from the sheet container 40A or 40B toward the secondary transfer area Tr. Moreover, the image forming portion 10 includes: a fourth transport path R4 for transporting the sheet onto which the toner images of the respective colors are transferred at the secondary transfer area Tr, so that the sheet passes the fixing unit 60, the cooling unit 80, and the curl correction unit 85; and a fifth transport path R5 for transporting the sheet from the curl correction unit 85 toward a sheet stacking portion 44 provided at an exit portion of the image forming apparatus 1.

Transport rolls and transfer belts are arranged along the first transport path R1 to the fifth transport path R5, sequentially transporting a sheet being fed.

<Description of Duplex Transport System>

As a duplex transport system, the image forming portion 10 includes: an intermediate sheet container 42 that temporarily holds the sheet having a first surface onto which the toner images of the respective colors are fixed; a sixth transport path R6 for transporting the sheet from the curl correction unit 85 toward the intermediate sheet container 42; and a seventh transport path R7 for transporting the sheet held in the intermediate sheet container 42 toward the third transporting path R3 described above. The image forming portion 10 further includes: a switching mechanism 43 that is placed downstream of the curl correction unit 85 in a sheet transport direction, and that selectively switches the transport direction of the sheet between the fifth transport path R5 for transporting the sheet toward the sheet stacking portion 44 and the sixth transport path R6 for transporting the sheet toward the intermediate sheet container 42; and pick-up rolls 45 that pick up the sheet held in the intermediated container 42 and transport the sheet toward the seventh transport path R7.

<Description of Image Forming Operations>

Next, a description is given of basic image forming operations of the image forming apparatus 1 according to the exemplary embodiment.

The image forming units 11 of the image forming portion 10 form toner images of colors of C, M, HC, HM, Y, and K, respectively, by an electrophotographic process using the above-described functional members. The primary transfer rolls 21 sequentially transfer the toner images of the respective colors formed on the respective image forming units 11 onto the intermediate transfer belt 20 (primary transfer) to form a composite toner image in which the toner images of the respective colors are superimposed on one another. Along with the movement of the intermediate transfer belt 20 (arrow direction), the composite toner image on the intermediate transfer belt 20 is transported to the secondary transfer area Tr where the secondary transfer roll 22 is placed.

Meanwhile, in the sheet transport system, according to the timing at which the image forming units 11 start image formation, the pick-up roll 41A or 41B rotates and picks up a sheet from the sheet container 40A or 40B, whichever is designated by the UI portion 90, for example. The sheet picked up by the pick-up roll 41A or 41B is transported along the first transport path R1 or the second transport path R2 and then by the third transport path R3, and reaches the secondary transfer area Tr.

In the secondary transfer area Tr, the composite toner image held on the intermediate transfer belt 20 is collectively transferred to the sheet by a transfer electric field formed by the secondary transfer roll 22 (secondary transfer).

Thereafter, the sheet to which the composite toner image is transferred is separated from the intermediate transfer belt 20 and is transported to the fixing unit 60 along the fourth transport path R4. The composite toner image on the sheet transported to the fixing unit 60 is subjected to a fixing process by the fixing unit 60 and is thus fixed onto the sheet. Then, the sheet having the fixed image formed thereon is cooled by the cooling unit 80, and a curl of the sheet is then removed by the curl correction unit 85. After that, in a simplex printing mode, the sheet having passed the curl correction unit 85 is led by the switching mechanism 43 to the fifth transport path R5 and is transported toward the sheet stacking portion 44.

Note that the cleaners 16 remove toner attached to the photoconductive drums 12 after the primary transfer (residual toner after primary transfer), and a belt cleaner 26 removes toner attached to the intermediate transfer belt 20 after the secondary transfer (residual toner after secondary transfer).

In a duplex printing mode, on the other hand, the sheet having the first surface onto which the image is fixed by the above described process passes the curl correction unit 85 and then is led by the switching mechanism 43 to the sixth transport path R6 to be transported to the intermediate sheet container 42. Then, according to the timing at which the image forming units 11 start image formation on a second surface of the sheet, the pick-up rolls 45 rotate and pick up the sheet from the intermediate sheet container 42. The sheet picked up by the pick-up rolls 45 is transported along the seventh transport path R7 and the third transport path R3, and reaches the secondary transfer area Tr.

In the secondary transfer area Tr, as in the case of the first surface, the composite toner image for the second surface held on the intermediate transfer belt 20 is collectively transferred onto the sheet by a transfer electric field formed by the secondary transfer roll 22 (secondary transfer).

Then, as in the case of the first surface, the sheet having the toner image transferred on both surfaces undergoes fixing at the fixing unit 60, is cooled by the cooling unit 80, and a curl of the sheet is removed by the curl correction unit 85. After that, the sheet having passed the curl correction unit 85 is led by the switching mechanism 43 to the fifth transport path R5 and is transported toward the sheet stacking portion 44.

In a manner described above, the cycle of the image formation process of the image forming apparatus 1 is repeated in cycles for the number of prints to be produced.

<Description of Fixing Unit Configuration>

Next, a description is given of the fixing unit 60 used in the image forming apparatus 1 of the exemplary embodiment.

Figure 2:
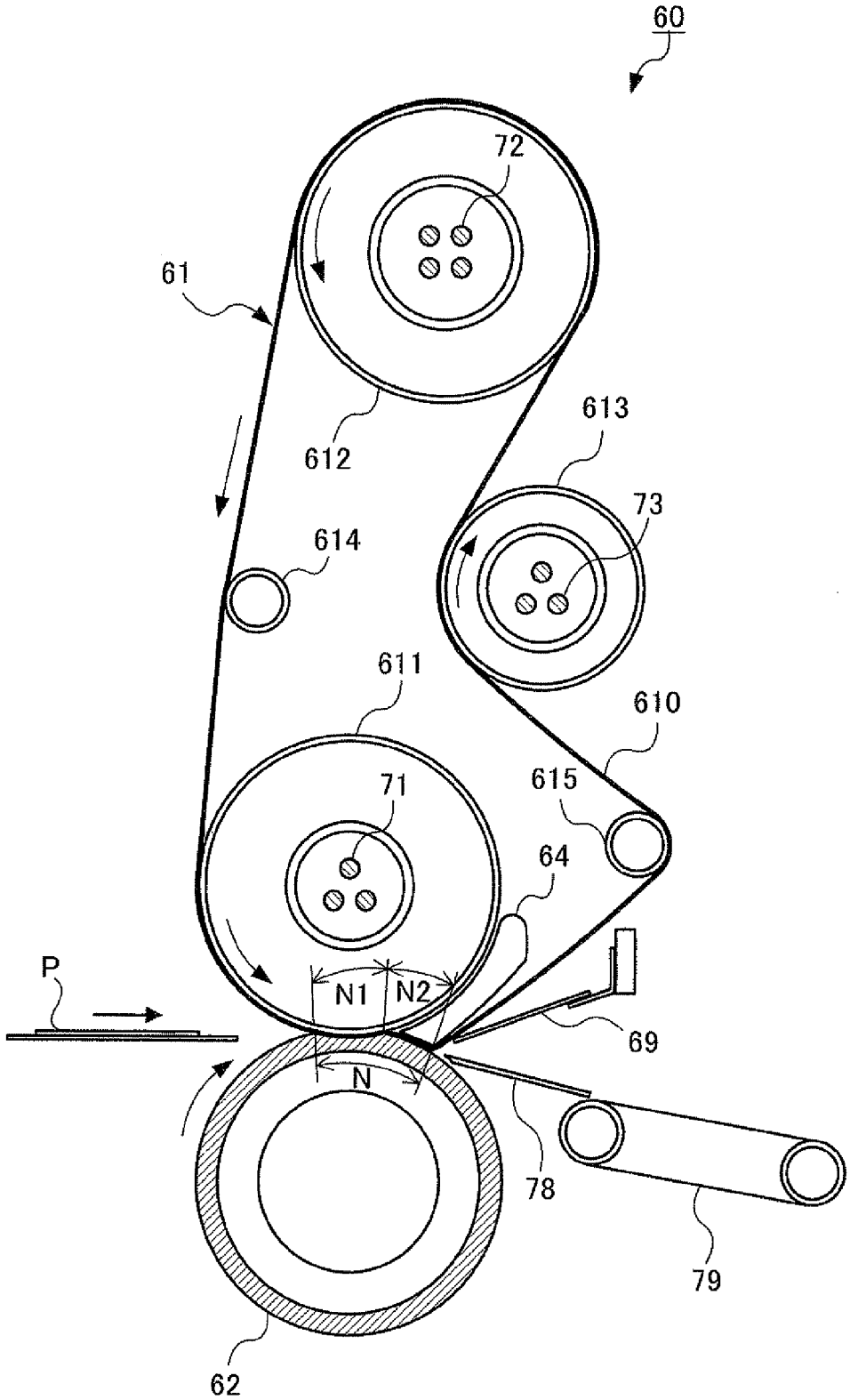
FIG. 2 is a cross-sectional view illustrating the configuration of the fixing unit of the exemplary embodiment.

FIG. 2 is a cross-sectional view illustrating the configuration of the fixing unit 60 of the exemplary embodiment. As main parts, the fixing unit 60 includes a fixing belt module 61 and a pressure roll 62. The pressure roll 62 is an example of a pressure member configured to be contactable with and separable from the fixing belt module 61.

The fixing belt module 61 includes a fixing belt 610, a fixing roll 611, an inside heating roll 612, and an outside heating roll 613. The fixing belt 610 is an example of a heating member that fixes a toner image on a sheet P. The fixing roll 611 is a tensioning member that is placed facing the pressure roll 62 with the fixing belt 610 interposed therebetween and that rotates while providing a tension to the fixing belt 610.

The fixing roll 611 heats the fixing belt 610 from inside at a nip portion (heating pressure portion) N which is an area where the fixing belt module 61 and the pressure roll 62 are in pressure contact with each other (in contact while pressing each other). The inside heating roll 612 is an example of an inside heating unit that heats the fixing belt 610 while providing a tension to the fixing belt 610 from inside. The outside heating roll 613 is an example of an outside heating portion that heats the fixing belt 610 while providing a tension to the fixing belt 610 from outside. The fixing belt module 61 also includes a tensioning roll 614, a peeling pad 64, and a tensioning roll 615. The tensioning roll 614 provides a tension to the fixing belt 610 between the fixing roll 611 and the inside heating roll 612 (upstream of nip portion N). The peeling pad 64 is an example of a peeling member placed downstream of the nip portion N and adjacent to the fixing roll 611. The tensioning roll 615 provides a tension to the fixing belt 610, downstream of the nip portion N.

The fixing belt 610 is formed of a base layer made of, for example, a polyimide resin, an elastic layer stacked on a surface side (outer circumferential side) of the base layer and made of a silicon rubber, and a release layer covering the elastic layer and made of a PFA (tetrafluoroethylene-perfluoro alkyl vinyl ether copolymer resin). Here, the elastic layer is provided particularly to improve the quality of color images. Specifically, a toner image held on the sheet P, which is to be fixed later, is formed by laminating powder toners of respective colors. For this reason, to apply heat evenly to the entire toner image at the nip portion N, the surface of the fixing belt 610 may desirably change shape according to the surface unevenness of the toner image on the sheet P.

The fixing roll 611 is a cylindrical roll formed of aluminum or SUS, for example, and rotates in a direction shown by an arrow in FIG. 2 by a rotational driving force of a drive motor (not shown). Then, the fixing roll 611 is heated to a predetermined temperature (e.g., 150° C.) by for example three halogen heaters 71 placed inside the fixing roll 611 as a heating source.

The inside heating roll 612 is a cylindrical roll formed of aluminum or SUS, for example. The fixing roll 612 is heated to a predetermined temperature (e.g., 190° C.) by for example four halogen heaters 72 placed inside as a heating source.

Further, at both end portions, the inside heating roll 612 is provided with spring members (not shown) that press the fixing belt 610 from inside to outside, setting the overall tension of the fixing belt 610 to, for example, 15 kgf.

The inside heating roll 612 is further provided with a mechanism for controlling meandering (belt walk) of the fixing belt 610. Specifically, a belt edge position detecting mechanism (not shown) is provided near the inside heating roll 612 to detect the position of an edge of the fixing belt 610. The inside heating roll 612 is further provided with a displacement mechanism (not shown) for displacing one of edge portions of the inside heating roll 612 in a direction orthogonal to an axis direction of the inside heating roll 612. The displacement mechanism displaces the fixing belt 610 in the axis direction of the inside heating roll 612 by displacing one of the edge portions of the inside heating roll 612 according to a detection result of the belt edge position detecting mechanism. The belt walking of the fixing belt 610 is thus controlled.

The outside heating roll 613 is a cylindrical roll formed of aluminum or SUS, for example. The outside heating roll 613 is heated to a predetermined temperature (e.g., 190° C.) by for example three halogen heaters 73 placed inside as a heating source.

As described, the fixing unit 60 of the exemplary embodiment employs a configuration in which the fixing belt 610 is heated by the fixing roll 611, the inside heating roll 612, and the outside heating roll 613.

The peeling pad 64 is a block member having a substantially arc-shaped cross section and being formed of a rigid body such as a metal like SUS or a resin. Over the entire area of the fixing roll 611 in the axis direction, the peeling pad 64 is placed to be secured at a position downstream of and adjacent to an area where the pressure roll 62 is in pressure contact with the fixing roll 611 with the fixing belt 610 interposed therebetween (hereinafter, referred to as "roll nip portion N1"). The peeling pad 64 is installed to evenly press an area of a predetermined width (e.g., a 5 mm nip width in a traveling direction of the fixing belt 610) of the pressure roll 62 with the fixing belt 610 interposed therebetween with a predetermined load (e.g., 10 kgf average). The peeling pad 64 forms a "peeling pad nip portion N2" next to the roll nip portion N1.

The pressure roll 62 is a member that forms the nip portion N between itself and the fixing belt 610 by being pressed against the outer circumferential surface of the fixing belt 610. The nip portion N is where the sheet P holding an unfixed toner image passes. For example, the pressure roll 62 has a cylindrical roll formed of aluminum or SUS as a base on which an elastic layer formed of a silicon rubber and a release layer formed of a PFA tube are sequentially laminated in this order. The pressure roll 62 is placed to be contactable with and separable from the fixing belt module 61. When in contact (pressure contact) with the fixing belt module 61 while pressing thereagainst, the pressure roll 62 rotates in a direction shown by an arrow, driven by the fixing roll 611 of the fixing belt module 61 rotating in another direction shown by an arrow.

<Description of Fixing Operations of Fixing Unit>

Next, a description is given of fixing operations of the fixing unit 60 of the exemplary embodiment.

The sheet P on which a composite toner image (unfixed toner image) is electrostatically transferred at the secondary transfer area Tr (refer to FIG. 1) of the image forming apparatus 1 is transported toward the nip portion N (refer to FIG. 2) of the fixing unit 60 along the fourth transport path R4 (refer to FIG. 1). Then, the unfixed toner image held on the surface of the sheet P passing the nip portion N is fixed onto the sheet P by pressure and heat acting mainly on the roll nip portion N1.

Specifically, in the fixing unit 60 of the exemplary embodiment, heat acting on the roll nip portion N1 is supplied mainly by the fixing belt 610. The fixing belt 610 is heated by: heat supplied through the fixing roll 611 from the halogen heaters 71 placed inside the fixing roll 611; heat supplied through the inside heating roll 612 from the halogen heaters 72 placed inside the inside heating roll 612; and heat supplied through the outside heating roll 613 from the halogen heaters 73 placed inside the outside heating roll 613. Thus, heat energy is supplied from not only the fixing roll 611, but also the inside heating roll 612 and the outside heating roll 613. Consequently, a sufficient amount of heat may be obtained in the roll nip portion N1 even at a high process speed.

In the fixing unit 60 of the exemplary embodiment, the fixing belt 610 functioning as a direct-heating member may be configured with an extremely small heat capacity. In addition, the fixing belt 610 is configured to be in contact with each of the heat supplying members, the fixing roll 611, the inside heating roll 612, and the outside heating roll 613, with a large wrap area (a large wrap angle). Consequently, the sufficient amount of heat is supplied from the fixing roll 611, the inside heating roll 612, and the outside heating roll 613 in a short cycle in which the fixing belt 610 rotates one revolution. Accordingly, it takes only a short time for the fixing belt 610 to regain a temperature capable of fixing. Thereby, a predetermined fixing temperature is maintained at the roll nip portion N1.

As a result, even when sheets pass the fixing unit 60 of the exemplary embodiment successively at a high speed, the fixing unit 60 keeps its fixing temperature almost constant. Moreover, occurrence of a phenomenon in which the fixing temperature drops upon initiation of high-speed fixing operations (so-called "temperature droop phenomenon") is prevented. In particular, even in fixing to a thick sheet or the like requiring a large heat capacity, the fixing temperature is maintained and occurrence of the temperature droop phenomenon is prevented. Furthermore, because the fixing belt 610 has a small heat capacity, when the fixing temperature needs to be changed in the middle of the operations, depending on a sheet type (increasing and decreasing of the fixing temperature), the fixing temperature is easily changeable by adjusting outputs of the halogen heaters 71, the halogen heaters 72, and the halogen heaters 73.

Further, in the fixing unit 60 of the exemplary embodiment, the fixing roll 611 is a hard roll formed of aluminum, SUS, or the like, and the pressure roll 62 is a soft roll covered with an elastic layer. Accordingly, a nip area having a certain width in the traveling direction of the fixing belt 610 is formed in the roll nip portion N1, where the fixing roll 611 hardly deforms, while the surface of the pressure roll 62 deforms. As described, the side of the fixing roll 611 which is wrapped by the fixing belt 610 hardly changes shape in the roll nip portion N1. For this reason, the fixing belt 610 passes the roll nip portion N1 while keeping the moving speed almost constant. This prevents the fixing belt 610 from creasing or being deformed in the roll nip portion N1, so that a fixed image of good quality may be provided.

Subsequently, after passing the roll nip portion N1, the sheet P is transported to the peeling pad nip portion N2. In the peeling pad nip portion N2, the peeling pad 64 is pressed against the pressure roll 62, and the fixing belt 610 is in pressure contact with the pressure roll 62. Accordingly, the roll nip portion N1 has a shape curving downward due to the curvature of the fixing roll 611, whereas the peeling pad nip portion N2 has a shape curving upward due to the curvature of the pressure roll 62.

Accordingly, the sheet P heated and pressed under the curvature of the fixing roll 611 in the roll nip portion N1 changes its traveling direction in the peeling pad nip portion N2 according to the curvature of the pressure roll 62 which is curved in an opposite direction. In this direction change, an extremely little slippage occurs between the toner image on the sheet P and the surface of the fixing belt 610. Thereby, adhesion between the toner image and the fixing belt 610 weakens, facilitating the sheet P to be peeled off the fixing belt 610. Hence, the peeling pad nip portion N2 may be regarded as a preparation step for secure peeling in a final peeling step.

Then, since the fixing belt 610 is transported so as to wind around the peeling pad 64 in an exit of the peeling pad nip portion N2, the transport direction of the fixing belt 610 drastically changes at this exit. To be more specific, since the fixing belt 610 moves along the outer surface of the peeling pad 64, the fixing belt 610 is caused to form a large curve. For this reason, the sheet P whose adhesion to the fixing belt 610 is weakened in the peeling pad nip portion N2 is separated from the fixing belt 610 by the stiffness of the sheet P itself.

Then, the traveling direction of the sheet P separated from the fixing belt 610 is led by a peeling guide plate 69 serving as an example of a peeling guide member placed downstream of the peeling pad nip portion N2. The sheet P guided by the peeling guide plate 69 is thereafter transported toward the cooling unit 80 by an exit guide 78 serving as an example of a guide member and by an exit belt 79. More specifically, the peeling guide plate 69 is a member that separates the sheet P peeled off the fixing belt 610 from the fixing belt 610 completely, and that sets a traveling direction of the sheet P. The exit guide 78 and the exit belt 79 are members that smoothly guide, toward the cooling unit 80, the sheet P for which the traveling direction is set by the peeling guide plate 69.

With the operations described above, the fixing process of the fixing unit 60 is completed.

<Description of Exit Guide>

The sheet P having passed through the nip portion N is normally separated from the fixing belt 610 as described above, and then transported toward the cooling unit 80. However, there are some cases where the sheet P exits from the nip portion N while remaining to adhere to the pressure roll 62. This tends to occur in duplex printing. Specifically, in the duplex printing, the sheet P on the first surface of which a fixed image is formed is transported along the sixth transport path R6, the seventh transport path R7 and the third transport path R3 (refer to FIG. 1), then the color toner images on the intermediate transfer belt 20 are collectively and secondarily transferred onto the sheet P. After the secondary transfer, the sheet P enters the fixing unit 60 again via the fourth transport path R4 (refer to FIG. 1) for fixing the toner image on the second surface thereof. At this time, the fixed image formed on the first surface lies on the pressure roll 62 side. In some cases, the toner forming the fixed image on the first surface is partially melted again by the heat supplied at the nip portion N. As a result of applying pressure together with the heat at the nip portion N, through the medium of the melted toner, the sheet P and the pressure roll 62 come to a state of easily adhering to each other.

If a normal fixing operation is carried out while the sheet P and the pressure roll 62 remain adhering to each other, a sheet jam occurs owing to the sheet P wrapping around the pressure roll 62. Accordingly, in the exemplary embodiment, the exit guide 78 is provided with pawl members 790 to peel the sheet P from the pressure roll 62.

Figure 3:
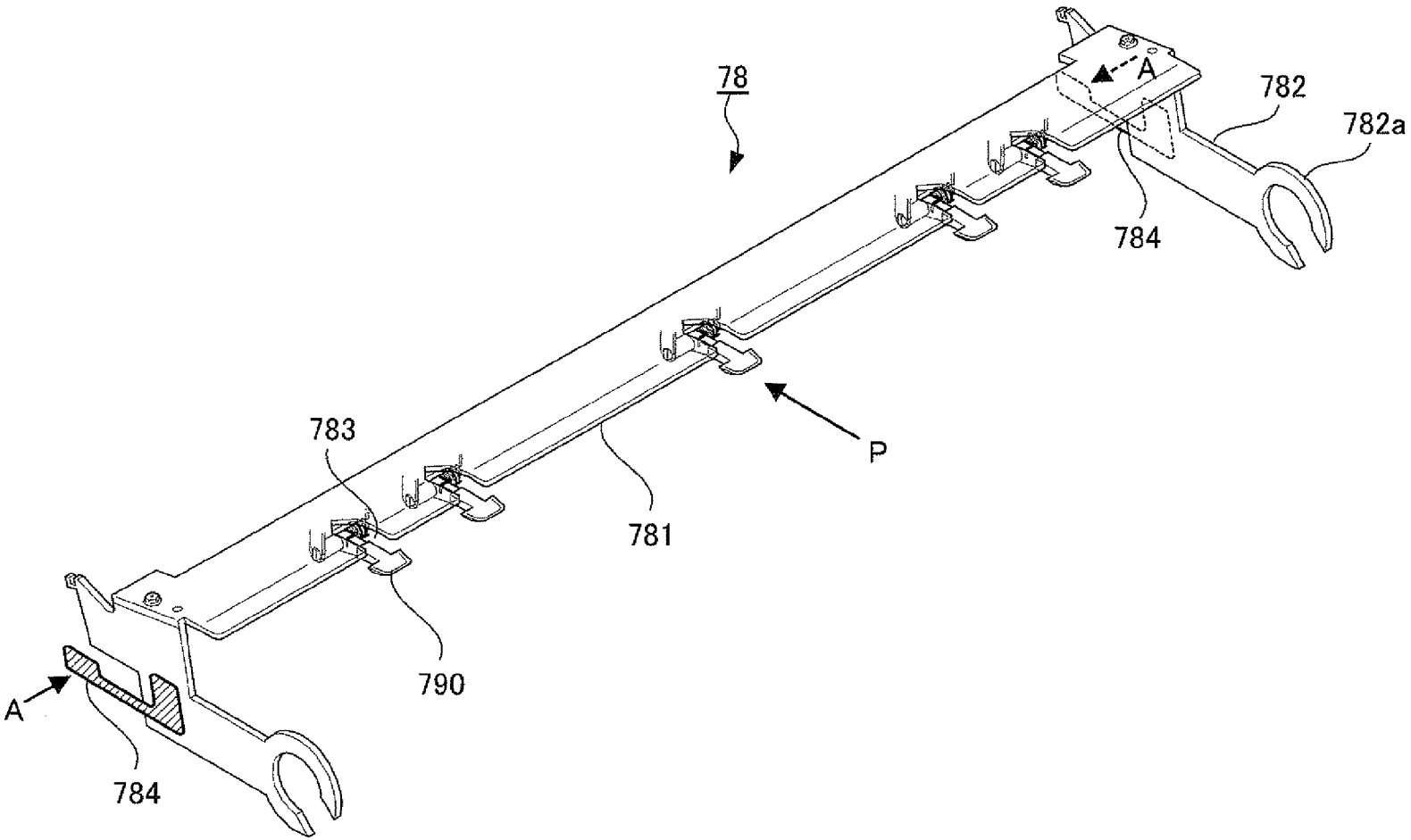
FIG. 3 illustrates an exit guide equipped with pawl members in the exemplary embodiment.
Figure 4:
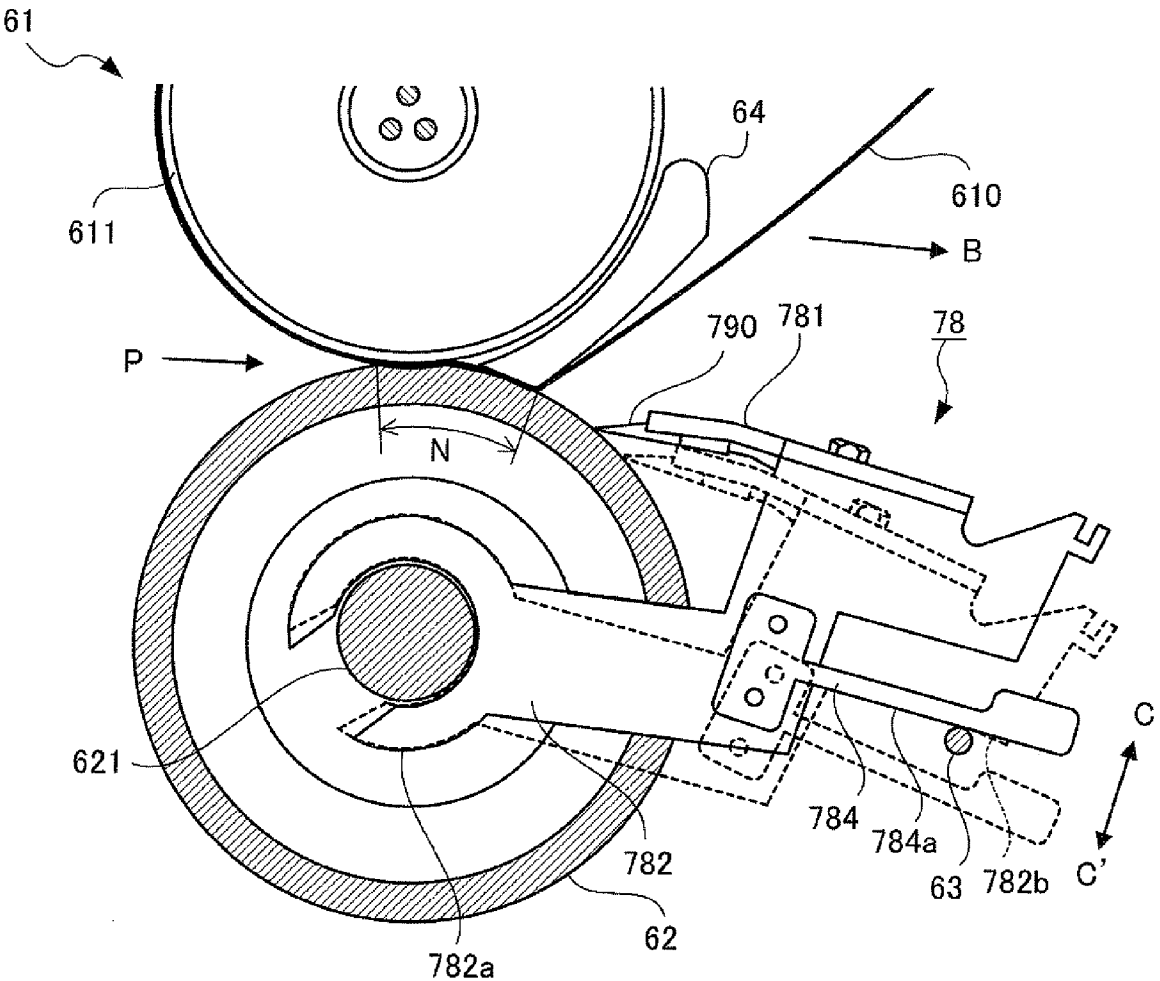
FIG. 4 illustrates attachment of the exit guide to a pressure roll in the exemplary embodiment.

FIG. 3 illustrates the exit guide 78 equipped with the pawl members in the exemplary embodiment. FIG. 4 illustrates attachment of the exit guide 78 to the pressure roll 62 in the exemplary embodiment. Hereinafter, the exit guide 78 in the exemplary embodiment will be described with reference to FIGS. 3 and 4.

The exit guide 78 shown in FIGS. 3 and 4 includes, as a main part thereof: a guide plate 781 as an example of a plate member that guides the sheet P having passed through the nip portion N; attachment members 782 provided at a lower portion of the guide plate 781 to secure the exit plate 78 to the pressure roll 62; secure position defining members 784 that define a secure position of the exit guide 78; and the pawl members 790 to peel the sheet P adhering to the pressure roll 62 therefrom.

The guide plate 781 guides the sheet P, having exited from the nip portion N, with an upper surface thereof and transports the sheet P toward the exit belt 79. In the exemplary embodiment, the guide plate 781 has five cutout portions 783 cutting toward the pressure roll 62. The pawl members 790 are attached to positions corresponding to the cutout portions 783 and retained.

Each of the attachment members 782 has an arc shape at a tip end portion 782*a* thereof. As shown in FIG. 4, the tip end portion 782*a* is coupled to a part of a rotation axis 621 of the pressure roll 62, thus securing the entire exit guide 78 to the pressure roll 62. With such a configuration, the exit guide 78 is rotatable around a part of the tip end portion 782*a*.

The secure position defining member 784 is formed of a thin plate of stainless steel or the like. The exit guide 78 is allowed to be movable between a first secure position and a second secure position by changing a positional relationship between a pin 63 provided to the fixing unit 60 (refer to FIG. 2) and the secure position defining members 784, which will be described in detail later.

Each of the pawl members 790 has a pawl portion at a tip end thereof for peeling the sheet P adhering to the pressure roll 62 therefrom. The pawl members 790 are urged against the pressure roll 62 by an elastic member such as a spring member not shown in the figure. As a result, the pawl portion of the pawl member 790 is brought into contact with the pressure roll 62 with a predetermined pressure, and intimately attached to the pressure roll 62. If the sheet P adhering to the pressure roll 62 is transported under this state, the pawl portion of the pawl member 790 enters between the pressure roll 62 and the sheet P. Accordingly, the sheet P is peeled from the pressure roll 62. The sheet P that has been peeled off is guided by the upper surfaces of the pawl members 790 and forwarded to the guide plate 781.

Here, in the exemplary embodiment, the belt module 61 is assembled as one piece. Consequently, in maintenance work or the like, the belt module 61 may be detached as one piece. In this case, the belt module 61 is separated from the pressure roll 62 and then detached. In FIG. 4, at least the fixing belt 610, the fixing roll 611 and the peeling pad 64 are separated from the pressure roll 62 as one piece.

Further, at this time, the belt module 61 is disengaged from a secure position thereof and then detached in the exemplary embodiment. Specifically, in FIG. 4, the belt module 61 is disengaged from the secure position thereof by once being moved in a direction of arrow B. Thereafter, the belt module 61 is detached by being moved upwardly in FIG. 4.

Under normal conditions, disengagement of the belt module 61 from the secure position and detachment thereof may be performed without interference with the exit guide 78. However, in the case where a sheet jam occurs near the nip portion N, the above-described disengagement and detachment operation of the belt module 61 is sometimes unavailable because of a jammed sheet P. Specifically, in some cases, the jam of the sheet P occurs at a position adjacent to the pressure roll 62 and in a region downstream of the nip portion N, namely, at a position in the proximity of the pawl members 790 of the exit guide 78. This occurs, for example, when the sheet P stays to adhere to the fixing belt 610 or wraps around the pressure roll 62 in the case where the sheet P exits from the nip portion N in the state of adhering to the fixing belt 610 or the pressure roll 62. If the sheet jam occurs at this portion, the jammed sheet causes interference with the belt module 61, thus inhibiting disengagement of the belt module 61 from the secure position thereof. Upon removing the sheet P, operation of disengagement of the belt module 61 from the secure position thereof and operation of detachment of the belt module 61 become available. However, in the exemplary embodiment, the space where the sheet jam occurs is small due to the existence of the pawl members 790, in particular, and thereby the work on removal of the sheet P is attended with difficulty. Further, during the work, damage is sometimes caused inside the fixing unit 60.

In the exemplary embodiment, to facilitate removal of the jammed sheet P even in such a case, the exit guide 78 is provided with a moving mechanism, thus allowing the exit guide 78 to be movable.

Movement of the exit guide 78 is performed between a normal position, which is a first secure position to guide the sheet P, and a second secure position to which the exit guide 78 is retracted when the jam of the sheet P occurs at the position adjacent to the pressure roll 62 and in the region downstream of the nip portion N.

In FIG. 4, the first secure position C of the exit guide 78 is a position indicated by a solid line. The first secure position C at this time is defined by the secure position defining members 784. Specifically, lower side portions 784*a* of the secure position defining members 784 come into contact with the pin 63. Accordingly, the exit guide 78 is secured at this position. On the other hand, the second secure position C' is indicated by a dotted line. At this time, lower side portions 782*b* of the attachment members 782 come into contact with the pin 63, thus enabling to secure the exit guide 78 at this position.

To move the exit guide 78 from the first secure position C to the second secure position C', first, the secure position defining members 784 are bent in the directions of arrows A shown in FIG. 3. Since the secure position defining members 784 are thin plates formed of stainless steel or the like as described above, it is easy to bend the secure position defining members 784. Under this condition, the secure position defining members 784 are disengaged from the state to be defined by the pin 63, thus allowing the exit guide 78 to be movable. Next, the exit guide 78 is moved downwardly by being rotated around the rotation axis portion of the pressure roll 62. This movement may be performed until the lower side portions 782*b* of the attachment members 782 come into contact with the pin 63, and then the exit guide 78 is secured at the second secure position C'. Because the secure position defining members 784 are made of an elastic body, the secure position defining members 784 are restored to an original form by removing forces for bending the secure position defining members 784 in the directions of arrows A.

By retracting the exit guide 78 to the second secure position C' in this manner, the sheet P may be easily removed when the sheet jam occurs in the proximity of the nip portion N. Specifically, the exit guide 78 is retracted from the first secure position C to the second secure position C', thereby generating a space at the location where the sheet jam occurs, which is sufficient to remove the sheet P. Consequently, the jammed sheet P is removed with greater ease. Moreover, the damage inside the fixing unit 60 hardly occurs. After the sheet P is removed, the operation of disengagement of the belt module 61 from the secure position and the operation of detachment of the belt module 61 are available.

It should be noted that the above-described operations may be performed in a reverse order to move the exit guide 78 from the second secure position C' to the first secure position C.

It should also be noted that the image forming apparatus 1 of the electrophotographic system is taken as an example in the exemplary embodiment. However, the image forming apparatus 1 may employ an ink jet system.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a heating member that heats a recording medium;

a pressure member that forms a heating pressure portion between the pressure member and the heating member by coming into pressure contact with an outer circumferential surface of the heating member, the heating pressure portion passing through the recording medium;

a tensioning member that is placed to face the pressure member with the heating member interposed therebetween, and that provides a tension to the heating member; and a guide member that guides the recording medium having passed through the heating pressure portion, and that is movable between a first position and a second position, wherein the guide member rotates around a rotation axis of the pressure member, thereby moving between the first position and the second position.

2. The heating device according to claim 1, wherein the guide member includes:

a plate member that guides the recording medium;

a pawl member that is attached to the plate member, the pawl member entering between the pressure member and the recording medium to peel the recording medium from the pressure member; and an attachment member that is coupled to a rotation axis of the pressure member to allow the guide member to be rotatable around the rotation axis of the pressure member.

3. The heating device according to claim 2, wherein the heating member, the tensioning member and a peeling member are enabled to be separated from the pressure member as one piece.

4. The heating device according to claim 3, wherein the first position is a position where the guide member guides the recording medium, and the second position is a position to which the guide member is retracted.

5. The heating device according to claim 2, wherein the first position is a position where the guide member guides the recording medium, and the second position is a position to which the guide member is retracted.

6. The heating device according to claim 1, wherein the guide member includes:

a plate member that guides the recording medium;

a pawl member that is attached to the plate member, the pawl member entering between the pressure member and the recording medium to peel the recording medium from the pressure member; and an attachment member that is coupled to a rotation axis of the pressure member to allow the guide member to be rotatable around the rotation axis of the pressure member.

7. The heating device according to claim 6, wherein the heating member, the tensioning member and a peeling member are enabled to be separated from the pressure member as one piece.

8. The heating device according to claim 7, wherein the first position is a position where the guide member guides the recording medium, and the second position is a position to which the guide member is retracted.

9. The heating device according to claim 6, wherein the first position is a position where the guide member guides the recording medium, and the second position is a position to which the guide member is retracted.

10. The heating device according to claim 1, wherein the heating member, the tensioning member and a peeling member are enabled to be separated from the pressure member as one piece.

11. The heating device according to claim 10, wherein the first position is a position where the guide member guides the recording medium, and the second position is a position to which the guide member is retracted.

12. The heating device according to claim 1, wherein the heating member, the tensioning member and a peeling member are enabled to be separated from the pressure member as one piece.

13. The heating device according to claim 12, wherein the first position is a position where the guide member guides the recording medium, and the second position is a position to which the guide member is retracted.

14. The heating device according to claim 1, wherein the first position is a position where the guide member guides the recording medium, and the second position is a position to which the guide member is retracted.

15. The heating device according to claim 1, wherein the first position is a position where the guide member guides the recording medium, and the second position is a position to which the guide member is retracted.

16. The heating device according to claim 1, further comprising a peeling member that is placed in a region downstream of the heating pressure portion, in a direction in which the recording medium proceeds, and at a position adjacent to the tensioning member, the peeling member peeling the recording medium from the heating member.

17. The heating device according to claim 1, further comprising a peeling guide member that regulates a direction in which the recording medium proceeds, the recording medium having been guided by the guide member.

18. An image forming apparatus comprising:

an image forming unit that forms an image;

a transfer unit that transfers the image formed by the image forming unit onto a recording medium; and a heating unit including:

a heating member that heats the recording medium;

a pressure member that forms a heating pressure portion between the pressure member and the heating member by coming into pressure contact with an outer circumferential surface of the heating member, the heating pressure portion passing through the recording medium;

a tensioning member that is placed to face the pressure member with the heating member interposed therebetween, and that provides a tension to the heating member; and a guide member that guides the recording medium having passed through the heating pressure portion, and that is movable between a first position and a second position, wherein the guide member rotates around a rotation axis of the pressure member, thereby moving between the first position and the second position.

19. A heating device comprising a heating member that heats a recording medium;

a pressure member that forms a heating pressure portion between the pressure member and the heating member by coming into pressure contact with an outer circumferential surface of the heating member, the heating pressure portion passing through the recording medium;

a tensioning member that is placed to face the pressure member with the heating member interposed therebetween, and that provides a tension to the heating member; and a guide member that guides the recording medium having passed through the heating pressure portion, and that is movable between a first position and a second position; and a secure member that secures the guide member to the first secure position or the second secure position.

* * * * *